United States Patent [19]

Mursula

[11] 4,251,954

[45] Feb. 24, 1981

[54] COUPLING AND ARRESTING DEVICE FOR A WINDOW

[76] Inventor: Arvo Mursula, SF-63300 Alavus, Finland

[21] Appl. No.: 78,259

[22] Filed: Sep. 24, 1979

[30] Foreign Application Priority Data

Oct. 26, 1978 [FI] Finland ..... 783263

[51] Int. Cl.[3] ..... E05C 7/02

[52] U.S. Cl. ..... 49/65

[58] Field of Search ..... 49/65, 163, 168

[56] References Cited

U.S. PATENT DOCUMENTS 2,142,907 1/1939 Mains ..... 49/65 X

FOREIGN PATENT DOCUMENTS 692316 6/1940 Fed. Rep. of Germany ..... 49/65

28624 2/1957 Finland ..... 49/65

149023 11/1931 Switzerland ..... 49/65

*Primary Examiner*—Kenneth Downey

*Attorney, Agent, or Firm*—Biebel, French & Nauman

[57] ABSTRACT

A coupling and arresting device for a double-sashed window is disclosed comprising a pin fastened to one sash and an elongated coupling piece fastened to the other sash, the pin having an enlarged head received with friction in a longitudinal slot in the coupling piece. A two-armed lever having a long arm and short arm is pivotally mounted in conjunction with the coupling piece so that a hook at the free end of the long arm blocks the slot in the coupling piece. By manipulating the short arm the hook may be raised to leave the slot unblocked.

2 Claims, 3 Drawing Figures

COUPLING AND ARRESTING DEVICE FOR A WINDOW

BACKGROUND OF THE INVENTION

1. Field of the Invention

The present invention relates to a coupling and arresting device for inward-opening windows in which the outer sash and the inner sash are separately attached to the window frame by means of hinges situated on one and the same side of the sash. In this case the term inner sash denotes here and hereinafter the single inner sash of a double-sash window, or the inner and intermediate sashes of a triple-sash window, hinged and coupled to each other and attached to the window frame by means of the same hinges.

2. Description of the Prior Art

A coupling and arresting device is known which comprises a pin, with one of its ends enlarged, attached to one sash and a mating piece for the pin, provided with an oblong groove open at both ends, attached to the other sash, these two members adhering to each other by friction in such a manner that, for opening and closing the window, the pin can be moved along the groove in the mating piece and that friction between the pin and its mating piece keeps the sashes locked to each other at the desired open position, the length of the mating piece being such that, by opening the window beyond a predetermined opening angle, the pin can be removed from the groove of the mating piece.

In the known device, the mating piece has a detachable limiting member consisting of a rod which can be fitted into openings in the mating piece. The disadvantage in this case is that, on the one hand, such a detachable limiting member easily gets lost and, on the other hand, even a small child can detach it with the consequence that the window may open so much that the child may inadvertently fall out of the window.

SUMMARY OF THE INVENTION

The object of the present invention is to provide a limiting member for a coupling and arresting device of the type described above, without the above-mentioned disadvantages. The invention is characterized in that a pivotable lever has been fitted in conjunction with the mating piece, the lever being two-armed, one arm being many times longer than the other, the longer arm having at its end a hook which is normally situated in front of the groove of the mating piece, thereby preventing the release of the pin, but by pressing the shorter arm the longer arm can be raised to a position which leaves the groove free. The lower edge of the hook is preferably beveled so that the hook automatically rises over the pin when the window is being closed.

BRIEF DESCRIPTION OF THE DRAWING

The invention is described below in more detail with reference to that embodiment of the coupling and arresting device according to the invention which is depicted in the accompanying drawing.

DESCRIPTION OF THE PREFERRED EMBODIMENT

Figure 1:
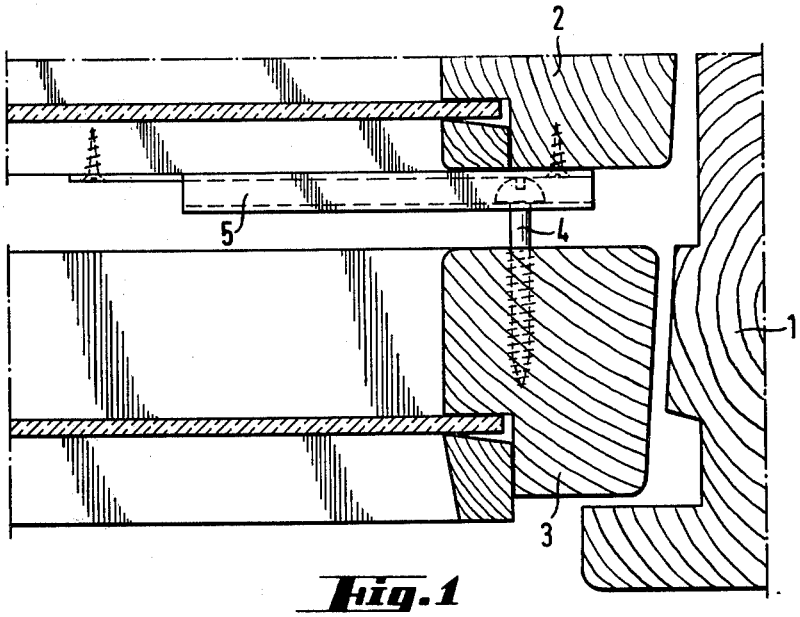
Figure 2:
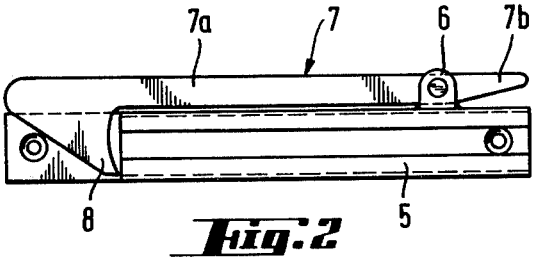
Figure 3:
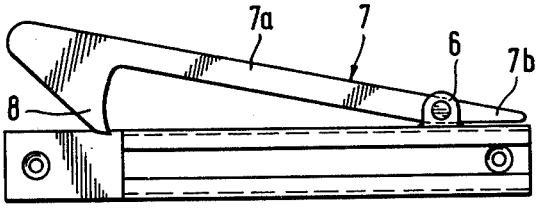

In the drawing,

FIG. 1 depicts a section of part of a window which has been provided with a coupling and opening device according to the invention, whereas FIGS. 2 and 3 depict side views of the mating piece and limiting member constituting parts of the device, in two different positions of operation.

In FIG. 1 of the drawing, 1 indicates the window frame, 2 is the inner sash and 3 is the outer sash. In the embodiment depicted, a pin 4 with a thickened end has been attached to the outer sash; in the depicted case the end of the pin in nearly hemispherical, but its shape can, of course, vary and can be, for example, the shape of a cylinder or a truncated cone.

A mating piece 5 has been attached to the inner sash 2 to coincide with the pin 4. The mating piece 5 consists of an oblong rail which is open at ends and which has a groove running from one end to the other; the groove has been dimensioned so that the arm of the pin 4 can be forced into it, the sides of the rail yielding. Thus, there is considerable friction between the pin 4 and the mating piece 5, which can further be reinforced by dimensioning the mating piece 5 in relation to the end of the pin 4 in such a manner that there is friction also between them or that the pin and/or the mating piece have/has been covered with a coating which increases friction. That length of the pin 4 which protrudes from the sash is in this case regulated so that, when the inner sash 2 is closed and locked to the frame 1, the outer sash is also closed and remains, under the effect of the pin 4 and the mating piece 5, locked without a separate latch in the outer sash. If the window is small, one single coupling and arresting device may suffice to keep the outer sash closed, but in a larger window it is preferable to fit such a device on two opposite edges of the window. For example, in a window with hinges on the side, the coupling devices can be located at the upper and lower edges of the window.

When the window is being opened, the pin 4 slides along the mating piece 5, and the inner and the outer sash 2, 3 remain coupled to each other at a constant distance from each other. The length of the mating piece 5 determines the largest opening angle, and by opening the window beyond this opening angle the pin 4 can be detached from the mating piece 5. In order to ensure that the window cannot inadvertently open beyond the said opening angle, the coupling and arresting device has, according to the invention, been provided with a limiting member, which at the same time serves as a child-security lock. The limiting member consists of a two-arm lever 7 which has been attached pivotably to a holder 6 attached to the mating piece 5 or the frame 2; one arm 7*a* is many times longer than the other arm 7*b*. The longer arm 7*a* is situated on that side of the mating piece 5 towards which the pin 4 moves when the window is opened. At the end of this arm there is a hook 8 which, when the limiting member 7 is in its normal position, shown in FIG. 2, closes the end of the groove in the mating piece 5, and thus the pin 4 cannot escape from the groove of the mating piece. The lower edge of the hook 8 has been beveled. Therefore, when the pin 4 has been detached from the mating piece 5 and the window is being closed, the hook 8 rises automatically over the pin 4 when thay meet and thereafter falls back to behind the pin. The lower edge of the shorter arm of the limiting member if also beveled towards the free end in such a manner that, by pressing the shorter arm 7*b*, the hook 8 can be caused to rise in the manner depicted in FIG. 3.

The opening of the limiting member 7 is very difficult for a small child, and therefore the limiting member constitutes a rather secure lock for children even when there is only one coupling and arresting device in the window. If there is one at both the upper and the lower edge it is impossible for a small child to open both limiting members simultaneously.

What is claimed is:

1. A coupling and arresting device for a window having an outer sash and an inner sash separately hinged to a frame by hinges situated on one end and the same side of the sashes, said coupling device comprising a pin having an enlarged head fastened to one of said sashes, and an elongated coupling piece fastened to the other of said sashes and having a longitudinal slot open at both ends for receiving said pin and engaging the same with friction, said coupling piece having a length selected to permit disengagement of said pin from said slot by opening said window beyond a predetermined opening angle, a two-armed lever pivotably mounted in conjunction with said coupling piece, one of said lever arms having a length being a multiple of the length of the other of said arms, said longer arm having a hook at the free end thereof normally blocking said slot in said coupling piece, and said shorter arm being beveled to permit raising of said hook to a position leaving said slot unblocked by manipulating said shorter arm.

2. A coupling and arresting device as in claim 1, said hook having a beveled front edge to permit said hook to slip over said pin when closing the window upon disengagement of said pin from said slot.

* * * * *